US006095247A

United States Patent [19]

Streich et al.

[11] Patent Number: 6,095,247

[45] Date of Patent: Aug. 1, 2000

[54] APPARATUS AND METHOD FOR OPENING PERFORATIONS IN A WELL CASING

[75] Inventors: Steven G. Streich, Duncan, Okla.; Mike Navarette, Cedar Park, Tex.; Jimmie D. Weaver, Duncan, Okla.; Richard L. Giroux, Katy, Tex.; David D. Szarka, Duncan, Okla.

[73] Assignee: Halliburton Energy Services, Inc., Duncan, Okla.

[21] Appl. No.: 08/976,320

[22] Filed: Nov. 21, 1997

[51] Int. Cl.[7] ..... E21B 29/02

[52] U.S. Cl. ..... 166/299; 166/376; 166/296; 166/63; 166/55; 166/297

[58] Field of Search ..... 166/299, 317, 166/376, 296, 297, 55, 63

[56] References Cited

U.S. PATENT DOCUMENTS

| | | | |
|---|---|---|---|
| 2,070,907 | 2/1937 | Laughinghouse | 137/111 |
| 2,178,845 | 11/1939 | Baker | 166/1 |
| 2,187,047 | 1/1940 | Miner | 166/1 |
| 2,201,290 | 5/1940 | Greene | 164/0.5 |
| 2,707,997 | 5/1955 | Zandmer et al. | 166/46 |
| 2,725,942 | 12/1955 | McCullough | 166/224 |
| 2,775,304 | 12/1956 | Zandmer | 166/100 |
| 3,090,436 | 5/1963 | Briggs | 166/63 |
| 3,120,268 | 2/1964 | Caldwell | 166/100 |
| 3,326,291 | 6/1967 | Zandmer | 166/100 |
| 3,417,822 | 12/1968 | Howell | 166/43 |
| 3,419,089 | 12/1968 | Venghiattis | 175/4.57 |
| 3,422,760 | 1/1969 | Mohaupt | 102/21.6 |
| 3,468,386 | 9/1969 | Johnson | 175/4.6 |
| 3,712,378 | 1/1973 | Oliver | 166/299 |
| 3,924,677 | 8/1974 | Prenner et al. | 166/100 |
| 4,285,398 | 8/1981 | Zandmer | 166/100 |
| 4,286,662 | 9/1981 | Page | 166/317 |
| 4,605,074 | 8/1986 | Barfield | 175/4.52 |
| 4,757,863 | 7/1988 | Challacombe et al. | 166/299 |
| 4,790,385 | 12/1988 | McClure et al. | 166/299 |
| 4,813,481 | 3/1989 | Sproul et al. | 166/51 |
| 4,846,281 | 7/1989 | Clary et al. | 166/373 |
| 4,969,524 | 11/1990 | Whiteley | 166/278 |
| 5,622,211 | 4/1997 | Martin et al. | 138/177 |

*Primary Examiner*—Eileen Dunn Lillis
*Assistant Examiner*—John Kreck
*Attorney, Agent, or Firm*—Robert A. Kent; Neal R. Kennedy

[57] ABSTRACT

An apparatus for opening perforations in a casing string. The casing string has a special casing section defining a plurality of holes therethrough. Rupturable ceramic discs or inserts are disposed in said holes and retained therein. The ceramic discs or inserts are adapted to withstand the fluid differential pressures normally present in the wellbore but are rupturable in response to impact by a mild explosive charge. The explosive charge is provided by detonating a length of det-cord disposed in the casing string adjacent to the holes in the special casing section. A method of perforating using this apparatus is also disclosed.

30 Claims, 3 Drawing Sheets

APPARATUS AND METHOD FOR OPENING PERFORATIONS IN A WELL CASING

BACKGROUND OF THE INVENTION

1. Field of the Invention

This invention relates to apparatus and methods for opening perforations in well casings, and more particularly, to a casing section having a plurality of holes plugged with ceramic rupture discs or inserts which can be ruptured by a mild explosive charge.

2. Description of the Prior Art

In the completion of oil and gas wells, it is a common practice to cement a casing string or liner in a wellbore and to perforate the casing string at a location adjacent to the oil or gas containing formation to open the formation into fluid communication with the inside of the casing string. To carry out this perforating procedure, numerous perforating devices have been developed which direct the explosive charge to penetrate the casing, the cement outside the casing and the formation.

In many instances in the completion and service of oil and gas wells, it is desirable to have a method and apparatus whereby perforations can be opened in the well casing string without penetrating the various layers of cement, resin-coated sand or other material located around the exterior of the casing string. Also, in some instances it is desirable to isolate sections of the well casing such that the sections do not have cement or other materials around the exterior of the isolated section. That is, there is cement above and below a casing section but not around it, which leaves an open annulus between the casing and the wellbore and associated formation. It may further be desirable to perforate such a section without the perforation penetrating the formation itself.

The present invention provides an apparatus and method for carrying out such procedures by utilizing a casing section which is plugged with ceramic discs or inserts which can be ruptured in response to an explosive charge detonated within the well casing and adjacent to the ceramic discs.

SUMMARY OF THE INVENTION

The present invention includes an apparatus for opening perforations in a casing string disposed in a wellbore and also relates to a method of perforating using this apparatus.

The apparatus comprises a casing string positionable in the wellbore, the casing string itself comprising a casing section defining a plurality of holes through a wall thereof. The apparatus further comprises a rupturable plug means disposed in each of the holes in the casing section for rupturing in response to impact by a mild explosive force, and explosive means for generating the explosive force in the casing section adjacent to the holes. The explosive force fractures the rupturable plug means and thereby opens the holes so that an inner portion of the casing string section is placed in communication with an outer portion thereof. The rupturable plug means is preferably characterized by a disc or insert made of a ceramic material which will withstand differential pressure thereacross but will fracture in response to impact by the explosive charge.

The apparatus further comprises retaining means for retaining the inserts in the holes prior to rupture of the inserts. The retaining means may comprise a shoulder in each of the holes for preventing radially inward movement of the inserts. The retaining means may also comprise a retainer ring disposed in each of the holes for preventing radially outward movement of the inserts. In another embodiment, the retaining means may comprise an adhesive disposed between the inserts and a portion of the casing string defining the holes. In an additional embodiment, the retaining means may comprise a backup ring threadingly engaged with each of the holes for preventing radially outward movement of the inserts. In still another embodiment, the retaining means may comprise a case threadingly engaged with each of the holes and defining an opening therein, wherein each of the inserts is disposed in one of the openings in a corresponding case. In this latter embodiment, the inserts are preferably shrink-fitted in the openings of the cases, and the retaining means may be further characterized by an adhesive between the inserts and the cases.

The apparatus may further comprise a sealing means for sealing between the inserts and the casing string section. The sealing means may be characterized by a sealing element, such as an O-ring, or may include the adhesive previously described.

In the preferred embodiment, the explosive means is characterized by a length of det-cord disposed along a longitudinal center line of the casing section. The det-cord preferably comprises an explosive present in the amount of about forty grams per foot to about eighty grams per foot, but additional types of det-cord or other explosive means may also be suitable.

The method of the present invention for opening perforations in a well casing may be said to comprise the steps of providing a casing string in the wellbore, wherein the casing string has a section defining a plurality of plugged holes therein, and detonating an explosive charge in the casing string adjacent to the holes and thereby unplugging the holes. The step of providing the casing string preferably comprises plugging the holes with a ceramic material which will rupture in response to detonation of the explosive charge.

The method may further comprise, prior to the step of detonating, a step of isolating the section of the casing string by placing material above and below the section of the casing string in a well annulus defined between the casing string and the wellbore. In one embodiment, this step of placing comprises cementing the well annulus above and below the section of the plugged casing string section.

In the preferred embodiment, the method also comprises placing the explosive charge in the well casing in the form of a portion of det-cord. Preferably, the det-cord is placed on the longitudinal center line of the casing string.

Numerous objects and advantages of the invention will become apparent as the following detailed description of the preferred embodiments is read in conjunction with the drawings which illustrate such embodiments.

DESCRIPTION OF THE PREFERRED EMBODIMENTS

Figure 1:
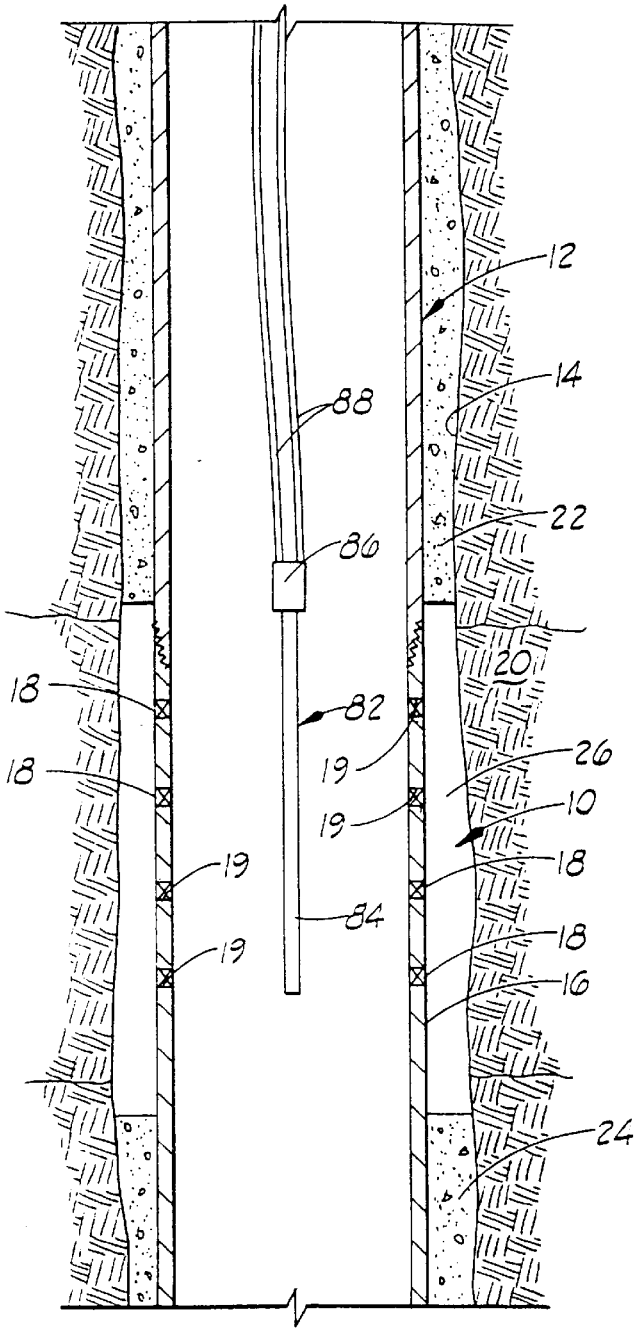
FIG. 1 illustrates the apparatus for opening perforations in a casing string of the present invention embodied as a plugged casing string section positioned in a wellbore.

Referring now to the drawings, and more particularly to FIG. 1, the apparatus for opening perforations in a casing string of the present invention is shown and generally designated by the numeral 10. Apparatus 10 comprises a casing string 12 disposed in a wellbore 14.

Casing string 12 itself comprises a special casing string section 16 having a plurality of rupturable plug means 18 disposed in holes 19 in section 16. Section 16 is positioned in wellbore 14 such that rupturable plug means 18 are generally adjacent to a well formation 20.

In the illustrated embodiment, an upper column of cement 22 is disposed above plug means 18 and in the annulus between casing string 12 and wellbore 14. Similarly, a lower column of cement 24 is disposed in the well annulus below plug means 18. That is, in the illustrated position of apparatus 10, a generally open annulus 26 is defined between section 16 and well formation 20. Annulus 26 is bounded at its upper end by upper cement column 22 and at its lower end by lower cement column 24.

Figure 2:
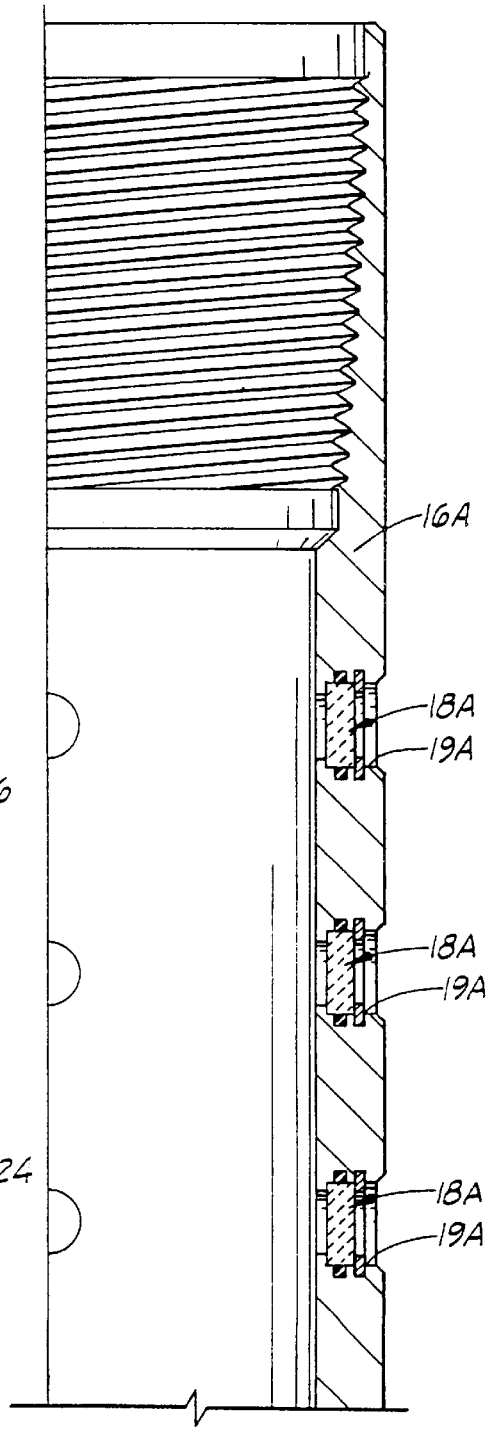
FIG. 2 shows a longitudinal cross section of a first preferred embodiment of the casing string section.
Figure 3:
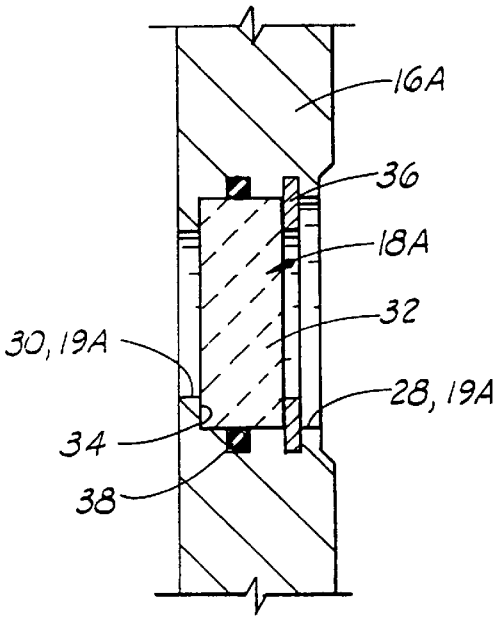
FIG. 3 is an enlargement of a portion of FIG. 2.

Referring now to FIGS. 2 and 3, a first embodiment of the apparatus will be discussed. In this embodiment, the casing section is identified by the numeral 16A with holes 19A therein and the rupturable plug means by 18A. Holes 19A in section 16A include a plurality of first bores 28 transversely therein with substantially concentric and smaller second bores 30 radially inwardly thereof.

Plug means 18A is characterized by a cylindrical disc or insert 32 which fits closely within first bore 28 and is disposed adjacent to a shoulder 34 extending between first bore 28 and second bore 30. Shoulder 34 prevents radially inward movement of disc 32. A retainer ring 36 holds disc 32 in place and prevents radially outward movement thereof.

A sealing means, such as an O-ring 38, provides sealing engagement between section 16A and the outside diameter of disc 32.

Figure 4:
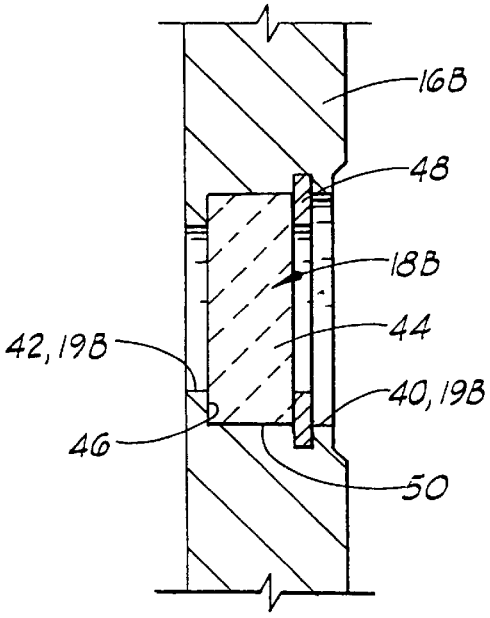
FIG. 4 is a cross-sectional enlargement showing a second embodiment.

FIG. 4 illustrates a second embodiment with casing section 16B having holes 19B therein and plug means 18B. Each hole 19B in section 16B includes a first bore 40 with a smaller, substantially concentric second bore radially inwardly thereof. Plug means 18B is characterized by a substantially cylindrical disc or insert 44 which is positioned adjacent to a shoulder 46 extending between first bore 40 and second bore 42. Shoulder 46 prevents radially inward movement of disc 44. As with the first embodiment, a retainer ring 48 is used to hold disc 44 in place, preventing radially outward movement thereof.

It will be seen that the second embodiment is substantially similar to the first embodiment except that it does not use an O-ring for a sealing means. In the second embodiment, a layer of an adhesive 50 is disposed around the outside diameter of disc 44 to glue the disc in place and to provide sealing between the disc and second 16B. Adhesive may also be placed along the portion of the disc which abuts shoulder 46. It will thus be seen that this adhesive assists retainer ring 48 in holding disc 44 in place and in preventing radial movement thereof.

Figure 5:
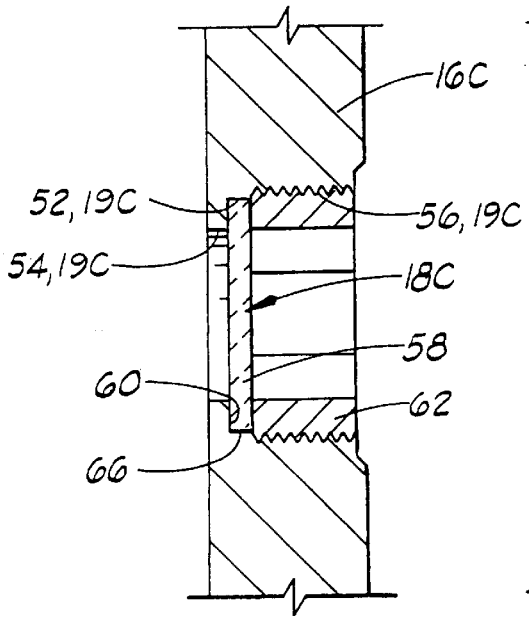
FIG. 5 presents an enlarged cross-sectional view of a third embodiment.
Figure 6:
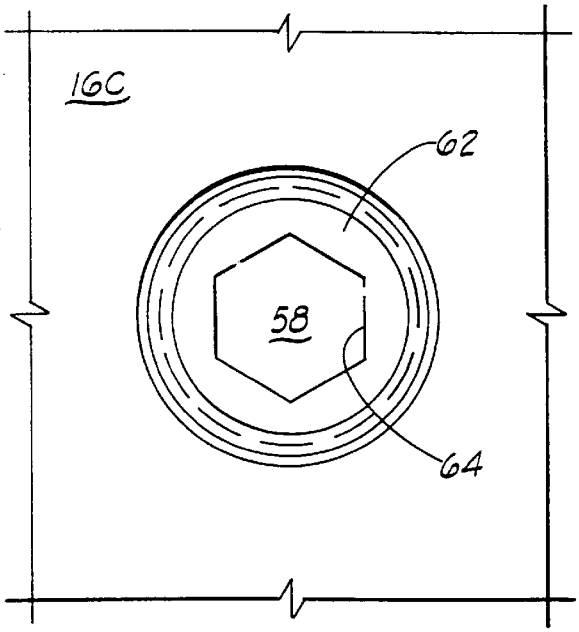
FIG. 6 is a side elevational view of the third embodiment.

Referring now to FIGS. 5 and 6, a third embodiment is shown which includes special casing section 16C having holes 19C therein and plug means 18C. Each hole 19C in section 16C includes a first bore 52 therein with a smaller, substantially concentric second bore 54 radially inwardly thereof. Each hole 19C also includes a threaded inner surface 56 formed in casing section 16C radially outwardly from first bore 52.

Plug means 18C is characterized by a rupturable disc or insert 58 which is disposed in first bore 52 adjacent to a shoulder 60 extending between first bore 52 and second bore 54. Shoulder 60 prevents radially inward movement of disc 58.

Disc 58 is held in place by a threaded backup ring 62 which is engaged with threaded inner surface 56 of section 16C, thereby preventing radially outward movement of disc 58. Backup ring 64 may be formed with a hexagonal inner socket 64 so that the backup ring may be easily installed with a socket wrench.

In a manner similar to the third embodiment, a layer of adhesive 66 may be disposed between disc 58 and casing section 16C to provide sealing therebetween and to assist in retaining disc 58 in place.

Figure 7:
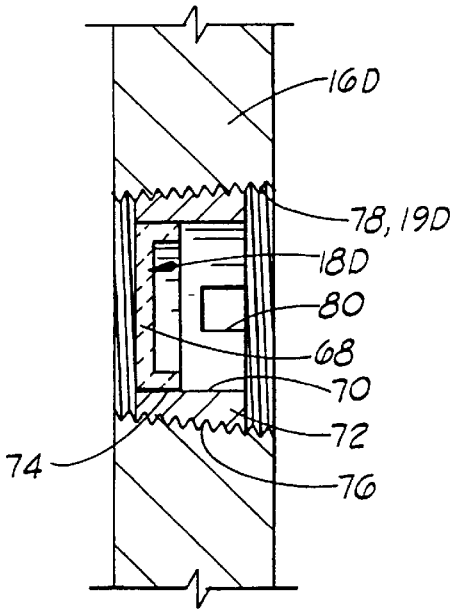
FIG. 7 shows an enlarged cross section of a fourth embodiment of the present invention.
Figure 8:
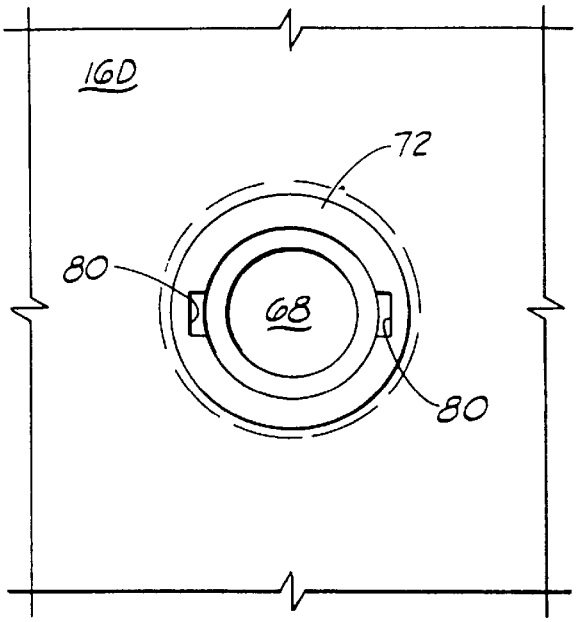
FIG. 8 is a side elevational view of the fourth embodiment of FIG. 7.

Referring now to FIGS. 7 and 8, a fourth embodiment of the invention is shown including special casing section 16D having holes 19D therein and plug means 18D. In this embodiment, a disc or insert 68 characterizes plug means 18D. Insert 68 is held by shrink fit in a bore 70 of a case 72. A layer of adhesive 74 may be disposed around the outside diameter of insert 68 prior to shrinking case 72 thereon.

Case 72 has an outer surface 76 which is formed as a tapered pipe thread and engages a corresponding tapered pipe thread inner surface 78 which characterizes each hole 19D of casing section 16D. Thus, case 72 prevents radial movement of insert 68 in either direction.

A pair of opposite notches 80 are formed in case 72 and extend outwardly from bore 70. Notches 80 are adapted for fitting with a spanner wrench so that case 72 may be easily installed in inner surface 78 of section 16D.

Preferably, but not by way of limitation, case 72 is made of stainless steel.

In all of the embodiments, the preferred material for discs or inserts 32, 44, 58 and 68 is a ceramic. This ceramic material is provided to first withstand static differential pressure as casing string 12 is positioned in wellbore 14 and other operations prior to perforating. It is necessary to first hold differential pressure so that fluids can be displaced past the rupturable plug means 18 and into the annulus between casing string 12 and wellbore 14. At this point, it is then desired to unplug casing string section 16.

The ceramic material has sufficient strength to permit it to withstand the differential pressures, but its brittleness permits it to be removed by means of impacting with a mild explosive charge. Referring back to FIG. 1, an explosive means 82 is thus disposed in casing string 12 adjacent to plug means 18. In the preferred embodiment, but not by way of limitation, this explosive means is characterized by a length of det-cord 84 connected to a detonating means such as a blasting cap 86. This assembly of blasting cap 86 and det-cord 84 may be positioned in casing section 16 by any means known in the art, such as by lowering it into the wellbore at the end of electric wires 88.

Two examples of det-cord which would be satisfactory are eighty grams per foot round RDX nylon sheath cord or forty grams per foot round HMX nylon sheath cord, although other materials would also be suitable. Therefore, the invention is not intended to be limited to any particular explosive means. Preferably, det-cord 84 is positioned along the center line of casing string 12.

Upon detonation of det-cord 84, the mild explosive force with fracture the ceramic material in rupture means 18. That is, in the various embodiments, discs or inserts 32, 44, 58 or 68 will be fractured and thereby respectively open holes 19A–19D through the walls of corresponding casing string sections 16A–16D. This explosive force from det-cord 84 is sufficient to blow out the discs or inserts but will not cause damage to the surrounding well formation 20.

With each of the four embodiments illustrated herein, rupturable plug means 18 may be installed either at a manufacturing facility or at the well site. Thus, there is great flexibility in preparing the apparatus.

It will be seen, therefore, that the apparatus and method for opening perforations in a casing string of the present invention are well adapted to carry out the ends and advantages mentioned as well as those inherent therein. While presently preferred embodiments of the invention have been shown for the purposes of this disclosure, numerous changes in the arrangement and construction of parts in the apparatus and steps in the method may be made by those skilled in the art. All such changes are encompassed within the scope and spirit of appended claims.

What is claimed is:

1. A method of opening perforations in a well casing comprising the steps of:

providing a casing string in a wellbore, wherein said casing string has a section defining a plurality of rupturably plugged holes therein;

cementing said casing string in said wellbore without cement being placed adjacent to said plugged holes;

positioning a separate explosive charge in said casing string adjacent to said holes; and detonating said explosive charge in said casing string adjacent to said holes for rupturing and thereby unplugging said holes.

2. An apparatus for use in a wellbore comprising:

a casing string positionable in said wellbore and adapted for being cemented therein, said casing string comprising a casing section defining a plurality of holes through a wall thereof;

rupturable plug means disposed in each of said holes in said casing section for rupturing in response to an explosive force;

explosive means for generating said explosive force, said explosive means being separate from said casing string and positionable therein after said casing string is positioned in said wellbore; and retaining means for retaining said plug means in said holes prior to rupturing, said retaining means comprising a retainer ring disposed in each of said holes for preventing radially outward movement of said plug means.

3. The apparatus of claim 2 wherein said plug means comprises an insert made of a ceramic material.

4. The apparatus of claim 2 wherein said retaining means comprises a shoulder in each of said holes for preventing radially inward movement of said plug means.

5. The apparatus of claim 2 further comprising sealing means for sealing between said plug means and said casing section.

6. The apparatus of claim 2 wherein said explosive means is positionable in said casing string adjacent to said holes whereby said rupturable plug means is ruptured such that said holes are substantially opened and an inner portion of said casing string is placed in communication with an outer portion thereof.

7. The apparatus of claim 6 wherein said explosive means is characterized by a length of det-cord.

8. The apparatus of claim 7 wherein said det-cord is disposed substantially along a longitudinal center line of said casing section.

9. The apparatus of claim 7 wherein said det-cord comprises an explosive present in the amount of about forty grams per foot to about eighty grams per foot.

10. An apparatus for use in a wellbore comprising:

a casing string positionable in said wellbore and adapted for being cemented therein, said casing string comprising a casing section defining a plurality of holes through a wall thereof;

rupturable plug means disposed in each of said holes in said casing section for rupturing in response to an explosive force;

explosive means for generating said explosive force, said explosive means being separate from said casing string and positionable therein after said casing string is positioned in said wellbore; and retaining means for retaining said plug means in said holes prior to rupturing, said retaining means comprising an adhesive disposed between said plug means and a portion of said casing section defining said holes.

11. The apparatus of claim 10 wherein said plug means comprises an insert made of a ceramic material.

12. The apparatus of claim 10 wherein said retaining means comprises a shoulder in each of said holes for preventing radially inward movement of said plug means.

13. The apparatus of claim 10 further comprising sealing means for sealing between said plug means and said casing section.

14. The apparatus of claim 10 wherein said explosive means is positionable in said casing string adjacent to said holes whereby said rupturable plug means is ruptured such that said holes are substantially opened and an inner portion of said casing string is placed in communication with an outer portion thereof.

15. The apparatus of claim 14 wherein said explosive means is characterized by a length of det-cord.

16. The apparatus of claim 15 wherein said det-cord is disposed substantially along a longitudinal center line of said casing section.

17. An apparatus for use in a wellbore comprising:

a casing string positionable in said wellbore and adapted for being cemented therein, said casing string comprising a casing section defining a plurality of holes through a wall thereof;

rupturable plug means disposed in each of said holes in said casing section for rupturing in response to an explosive force;

explosive means for generating said explosive force, said explosive means being separate from said casing string and positionable therein after said casing string is positioned in said wellbore; and retaining means for retaining said plug means in said holes prior to rupturing, said retaining means comprising a backup ring threadingly engaged with each of said holes for preventing radially outward movement of said plug means.

18. The apparatus of claim 17 wherein:

said retaining means comprises a case threadingly engaged with each of said holes and defining an opening therein; and each of said plug means is disposed in one of said openings in a corresponding case.

19. The apparatus of claim 18 wherein said plug means comprises inserts which are shrink-fitted in said openings.

20. The apparatus of claim 18 wherein said retaining means further comprises an adhesive disposed between said plug means and said cases.

21. The apparatus of claim 17 wherein said plug means comprises an insert made of a ceramic material.

22. The apparatus of claim 17 wherein said retaining means comprises a shoulder in each of said holes for preventing radially inward movement of said plug means.

23. The apparatus of claim 17 further comprising sealing means for sealing between said plug means and said casing section.

24. The apparatus of claim 17 wherein said explosive means is positionable in said casing string adjacent to said holes whereby said rupturable plug means is ruptured such that said holes are substantially opened and an inner portion of said casing string is placed in communication with an outer portion thereof.

25. The apparatus of claim 24 wherein said explosive means is characterized by a length of det-cord.

26. The apparatus of claim 25 wherein said det-cord is disposed substantially along a longitudinal center line of said casing section.

27. A method of opening perforations in a well casing comprising the steps of:

providing a casing string in a wellbore and cementing said casing string therein, wherein:

said casing string has a section defining a plurality of rupturably plugged holes therein; and said step of cementing comprises isolating said section of said casing string by placing cement above and below said section of said casing string in a well annulus defined between said casing string and said wellbore;

positioning a separate explosive charge in said casing string adjacent to said holes; and detonating said explosive charge in said casing string adjacent to said holes for rupturing and thereby unplugging said holes.

28. A method of opening perforations in a well casing comprising the steps of:

providing a casing string in a wellbore and cementing said casing string therein, wherein said casing string has a section defining a plurality of rupturably plugged holes therein, said holes being plugged with a ceramic material;

positioning a separate explosive charge in said casing string adjacent to said holes; and detonating said explosive charge in said casing string adjacent to said holes, for rupturing the ceramic material and thereby unplugging said holes.

29. A method of opening perforations in a well casing comprising the steps of:

providing a casing string in a wellbore and cementing said casing string therein, wherein said casing string has a section defining a plurality of rupturably plugged holes therein;

positioning a separate explosive charge in said casing string adjacent to said holes, said explosive charge being in the form of a portion of det-cord; and detonating said explosive charge in said casing string adjacent to said holes for rupturing and thereby unplugging said holes.

30. The method of claim 29 wherein said det-cord is positioned substantially along a longitudinal center line of said casing section.

* * * * *